United States Patent [19]

Sakamoto et al.

[11] 4,306,804

[45] Dec. 22, 1981

[54] EXPOSURE CONTROL AND OTHER COMPONENT CONTROL FOR ELECTROSTATIC COPYING MACHINE

[75] Inventors: Koji Sakamoto; Seiichi Miyakawa; Susumu Tatsumi, all of Tokyo, Japan

[73] Assignee: Ricoh Company, Ltd., Tokyo, Japan

[21] Appl. No.: 64,154

[22] Filed: Aug. 6, 1979

Related U.S. Application Data

[62] Division of Ser. No. 843,108, Oct. 18, 1977.

[30] Foreign Application Priority Data

| | | | |
|---|---|---|---|
| Oct. 19, 1976 | [JP] | Japan | 51-125388 |
| Nov. 18, 1976 | [JP] | Japan | 51-138977 |
| Nov. 18, 1976 | [JP] | Japan | 51-138978 |

[51] Int. Cl.[3] ..... G03G 15/00

[52] U.S. Cl. ..... 355/14 E; 118/679; 355/8; 355/14 D; 355/71

[58] Field of Search ..... 355/14 E, 14 D, 10, 355/3 DD, 3 R, 67, 71, 8; 118/663, 679

[56] References Cited

U.S. PATENT DOCUMENTS

| | | | |
|---|---|---|---|
| 3,788,739 | 1/1974 | Coriale | 355/14 E |
| 4,050,806 | 9/1977 | Miyakawa et al. | 355/14 D |

*Primary Examiner*—Richard L. Moses

*Attorney, Agent, or Firm*—Jordan and Hamburg

[57] ABSTRACT

An exposure unit radiates a light image of an original document onto a charged photoconductive member to form an electrostatic image through localized photoconduction. A developing unit applies a powdered developing substance comprising carrier particles and toner particles to the photoconductive member to develop the electrostatic image and produce a toner image which is transferred and fixed to a copy sheet to produce a permanent reproduction of the original document. Prior to exposure with the light image a reference electrostatic image is formed on the photoconductive member and the electrostatic potential thereof is measured. The intensity of the light image of the original document and/or a developing bias voltage are regulated in accordance with the sensed electrostatic potential. The reference image may be of a reference surface having a predetermined optical density or a portion of the original document produced by reverse optical scanning.

4 Claims, 7 Drawing Figures

EXPOSURE CONTROL AND OTHER COMPONENT CONTROL FOR ELECTROSTATIC COPYING MACHINE

This is a division, of application Ser. No. 843,108, filed Oct. 18, 1977.

BACKGROUND OF THE INVENTION

The present invention relates to improvements to an electrostatic copying machine.

A problem existing in prior art electrostatic copying machines utilizing a dry powdered developing substance comprising carrier particles and toner particles is determining the condition of the developing substance and replacing the same when it has deteriorated to an excessive extent. Since only the toner substance is consumed during the developing process, it is common practice to recycle the carrier particles and unused toner particles and add fresh toner particles to maintain the toner density, or the ratio of toner particles to carrier particles, at a constant value. However, prolonged reuse of the carrier particles causes degeneration or deterioration thereof and a consequent decrease in the developing ability of the developing substance. Such deterioration produces a reduction in toner image density and copies having a washed-out appearance. For this reason, it has further been common practice to replace the developing substance when a decrease in image density is visually observed or after the developing substance has been used to produce a predetermined number of copies.

This problem is complicated by the fact that the toner image density is effected by factors other than deterioration of the developing substance. Dirt accumulation or tarnish on the various optical components of the copying machine cause a reduction of the liquid image intensity incident on a photoconductive drum or the like of the machine and resultant variation in toner image density. Deterioration of the dielectric and photoconductive properties of the drum also cause variation in toner image density.

It is therefore impossible to determine the codition of the developing substance merely by observing the density of the copies produced by the machine. Good developing substance may be wasted by premature replacement and excessively deteriorated developing substance may be used too long.

Another problem which has existed heretofore in electrostatic copying machines is optimally controlling the exposure and developing bias voltage as a function of deterioration of various copying machine elements and the density or color of the background areas of original documents. Excessive exposure and bias voltage produced washed-out copies, or copies of insufficient density. In sufficient exposure and bias voltage produce copies with gray background areas.

SUMMARY OF THE INVENTION

The present invention precisely measures the condition of a developing substance by measuring the toner density with an electromagnetic means which may also be used to control replenishment of toner particles. The developing ability is determined optically. The developing substance is replaced when the difference between the toner density and developing ability exceeds a predetermined value. The exposure and bias voltage are optimally controlled by measuring the electrostatic potential of a reference electrostatic image formed on the drum by exposure to a reference light image. The reference light image may be of a reference surface having a predetermined optical density or a portion of the original document for copying produced by reverse scanning.

It is an object of the present invention to provide an improved electrostatic copying machine comprising means for determining exactly when a developing substance should be replaced.

It is another object of the present invention to provide an electrostatic copying machine comprising means for optimally controlling exposure intensity and developing bias voltage.

It is another object of the present invention to minimize the comsumption of developing substance in an electrostatic copying machine.

It is another object of the present invention to prevent gray backgrounds in copies of original document having white backgrounds.

It is another object of the present invention to eliminate several major causes of improper density in electrostatic copying.

It is another object of the present invention to provide a generally improved electrostatic copying machine.

Other objects, together with the foregoing, are attained in the embodiments described in the following description and illustrated in the accompanying drawing.

DESCRIPTION OF THE PREFERRED EMBODIMENTS

While the electrostatic copying machine of the invention is susceptible of numerous physical embodiments, depending upon the environment and requirements of use, substantial numbers of the herein shown and described embodiments have been made, tested and used, and all have performed in an eminently satisfactory manner.

Figure 3:
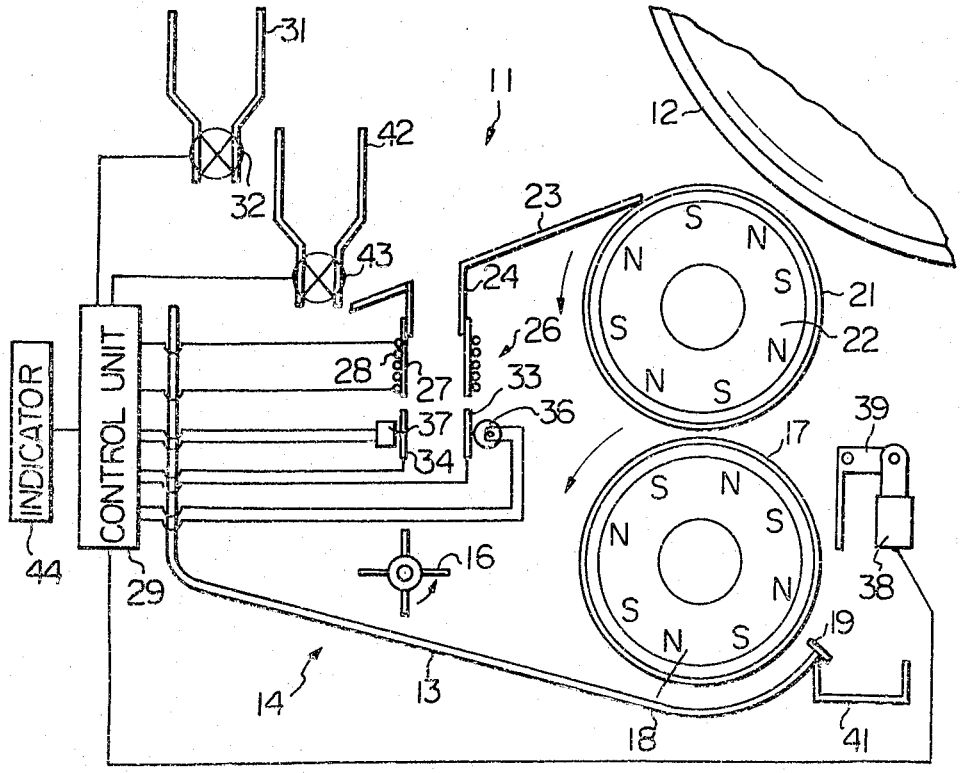
FIG. 3 is a schematic view of an electrostatic copying machine of the invention.

Referring now to FIG. 3 of the drawing, an electrostatic copying machine embodying the present invention is generally designated by the reference numeral 11 and comprises a photoconductive drum 12 which is rotated counterclockwise at constant speed. The drum 12 comprises a grounded metal cylinder with a photoconductive coating on the circumference thereof although not illustrated in detail.

Although not shown, an exposure optical system focusses a light image of an original document onto the drum 12 after the same is uniformly electrostatically charged. The light image causes localized photoconduction on the drum 12 and the formation of an electrostatic image.

A dry, powdery developing substance comprising carrier particles and toner particles is provided in a developing tank 13 of a developing unit 14. An impeller or agitator 16 provided near the bottom of the developing tank 13 is rotated counterclockwise and feeds the developing substance to a lower non-magnetic cylinder 17 which is rotated at constant speed in the counterclockwise direction. The agitator 16 further serves to generate an electrostatic charge in the developing substance through dry friction which causes the toner particles to adhere to the carrier particles. A permanent magnet 18 provided with a plurality of poles is fixedly mounted in the cylinder 17. The magnetic force of the magnet 18 causes the carrier particles and adhered toner particles to be attracted to the periphery of the cylinder 17 and form a magnetic brush thereon. A doctor blade 19 limits the thickness of the magnetic brush to a predetermined value.

A similar upper cylinder 21 is rotated counterclockwise between the cylinder 17 and the drum 12, and a similar multipole magnet 22 is mounted inside the cylinder 21. The magnet 22 is stronger than the magnet 18 and causes the developing substance to be transferred from the cylinder 17 to the cylinder 21 to form a magnetic brush thereon. The magnetic brush on the cylinder 21 engages the drum 12 to develop the electrostatic image and produce a toner image. More specifically, the toner particles are attracted to areas of the electrostatic image having a high electrostatic potential. Subsequent to development, the toner image is transferred and fixed to a copy sheet (not shown) to provide a permanent reproduction of the original document.

The carrier particles and consumed toner particles are scraped from the cylinder 21 by a scraper blade 23 and slide theredown into the developing tank 13 for reuse. A conduit 24 of suitably small diameter leads downwardly from the scraper blade 23 so that a portion of the developing substance scraped from the cylinder 21 falls down the conduit 24 into the developing tank 13.

An electromagnetic coil 26 comprising a bobbin 27 and a winding 28 is provided at the bottom of the conduit 24 in such a manner that the developing substance must drop therethrough. An electrical potential, preferably alternating (A. C.), is applied to the winding 28 from a control unit 29. The developing substance comprises the carrier particles which are ferromagnetic and the toner particles which are non-magnetic. The carrier particles in the developing substance passing through the coil 26 in effect constitute a ferromagnetic core of the coil 26 and increase the effective inductance thereof. The increase in inductance is inversely proportional to the toner density which is defined as the ratio of toner particles to carrier particles in the developing substance.

The control unit 29 comprises any known circuitry to calculate the toner density as a function of the effective inductance of the coil 26. Fresh toner substance is provided in a hopper 31 which opens into the developing tank 13. A solenoid valve 32 is opened or closed by the control unit 31 to allow or prevent toner substance from being fed into the developing tank 13 from the hopper 31.

Generally, the control unit 29 controls the solenoid valve 32 in such a manner that enough toner substance is mixed with the recycled developing substance to replace that consumed in the developing process. However, FIGS. 1 and 2 illustrate how the toner mixture ratio or toner density and the developing ability of the developing substance vary as a function of deterioration of the carrier particles and recycled toner particles in the developing substance.

Figure 1:
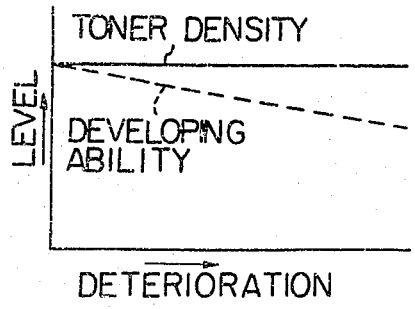
FIGS. 1 and 2 are graphs illustrating a principle of the present invention.

FIG. 1 illustrates the case in which the control unit 29, coil 26 and solenoid valve 32 are constructed to maintain the toner density constant. It will be seen that the developing ability progressively deteriorates along with the deterioration of the developing substance. This produces copies of insufficient density which appear washed out. FIG. 2 illustrates the case in which enough extra toner substance is added to the recycled developing substance to maintain the developing ability constant. After a certain point is reached, the toner density will become so high that the developing process will break down due to an insufficient proportion of carrier particles in the magnetic brush. In both FIGS. 1 and 2 it will be noticed that the difference between the toner density and the developing ability increases with the deterioration of the developing substance. This provides an accurate parameter for determining the precise condition of the developing substance.

In accordance with the present invention two transparent electrodes made of, for example NESA glass, are designated as 33 and 34 and provided just below the coil 26 in such a manner that the recycled developing substance is forced to pass therebetween. The control unit 29 applies an alternating electric field to the electrodes 33 and 34 which causes some of the developing substance to adhere thereto. The greater the developing ability of the developing substance the greater the amount of developing substance which adheres to the electrodes 33 and 34. A light source 36 and light sensor 37 are provided on opposite sides of the plates 33 and 34 respectively. The light source 36 provides a constant light output and the sensor 37 produces an output signal which varies in accordance with the optical density of the developing substance adhered to the electrodes 33 and 34. The greater the amount of adhered developing substance, the greater the optical density and the smaller the magnitude of the signal. Thus, the signal produced by the sensor 37 varies inversely in magnitude as a predetermined function of the developing ability of the developing substance.

Figure 2:
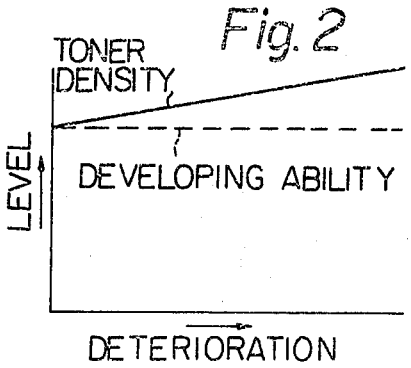

The control unit 29 calculates the toner density and developing ability from the signals produced by the coil 26 and sensor 37 respectively and further calculates the difference therebetween by means of a differential amplifier or the like (not shown) as illustrated in FIG. 1 or 2. When the difference exceeds a predetermined value at which the developing substance is known to be deteriorated beyond further practical use, the control unit 29 actuates a solenoid 38 which moves a scraper blade 39 into scraping engagement with the cylinder 17. The solenoid 38 is actuated long enough for all of the deteriorated developing substance in the developing tank 13 to be fed to the cylinder 21 by the agitator 16 and be scraped therefrom by the scraper blade 39 into a container 41.

The scraper blade 39 is then moved away from the cylinder 17 and the container 41 is removed to enable disposal of the deteriorated toner substance. A supply of fresh developing substance comprising fresh carrier particles and toner particles at the correct toner density is provided in a hopper 42. A solenoid valve 43 controlled by the control unit 29 is then opened to allow fresh developing substance from the hopper 42 to fall into and fill the developing tank 13 to replace the deteriorated developing substance which was removed.

The control unit 29 may energize an indicator 44 such as a light or buzzer when replacement of the developing substance is being effected. Generally, the control unit 29 will operate to maintain the toner density constant as illustrated in FIG. 1 or the developing ability constant as illustrated in FIG. 2, or to maintain a constant output signal from the coil 26 or sensor 37 respectively. However, it will be noted that in either case the difference between the toner density and developing ability increases as illustrated and that the principle of the invention is the same in both cases. Since deterioration of the developing substance occurs over a relatively long period of time, the measurement process of the invention may be effected at periodic intervals.

Figure 5:
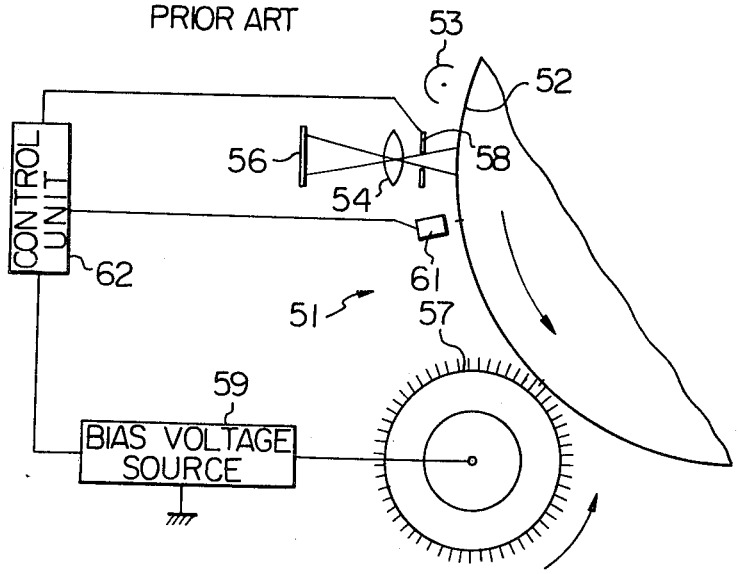
Fig. 5 PRIOR ART
FIG. 5 is a schematic view of a prior art electrostatic copying machine.

Referring now to FIG. 5, a prior art electrostatic copying machine 51 comprises a photoconductive drum 52 which is rotated counterclockwise at constant speed. The surface of the drum 52 is uniformly charged by a corona charging unit 53. An exposure optical system symbolized by a converging lens 54 focusses a light image of an original document 56 onto the drum 12 to form an electrostatic image. A developing unit 57 of the magnetic brush type applies a dry developing substance to the drum 52 to develop the electrostatic image.

The electrostatic potential of the background areas of the electrostatic image varies in accordance with deterioration of the optical system 54, drum 12, color of the background areas of the document 56 and other factors. For this reason, it is necessary to vary the intensity of the light image, or the exposure of the drum 12, by means of a slit type diaphragm 58. Furthermore, a developing bias voltage applied to the developing unit 57 is adjusted by means of a variable bias voltage source 59. An electrode 61 positioned adjacent to the drum 52 has a potential induced thereon corresponding to potential on the drum 52.

The bias voltage is selected to be equal to or slightly greater than the potential of the background areas of the electrostatic image. If the bias voltage is too low, the background areas will print gray. Conversely, if the bias voltage is too high, the entire copy will be lacking in density or appear washed out. An intense light image reduces the copy density and vice-versa. Generally speaking, there is an optimum combination of bias voltage for each value of potential of the background areas of the electrostatic image.

The induced potential on the electrode 61 is applied to a control unit 62 which controls the magnitude of the bias voltage applied to the developing unit 57 from the source 59 and also the aperture width of the diaphragm 58 through a solenoid or the like (not shown). The intensity of the light image is controlled by means of the diaphragm 58. The control unit 62 selects the optimum diaphragm opening and bias voltage in accordance with the potential induced on the electrode 61.

The control unit 62 functions to measure the potential of the leading edge of the electrostatic image and set the exposure and bias voltage in accordance therewith. It is not desirable to sense and vary the exposure and bias voltage continuously as such a process would result in uneven copies.

Figure 6:
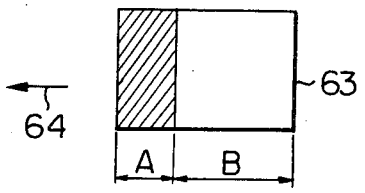
FIG. 6 is a diagram illustrating a principle of the invention.

Referring also to FIG. 6, it will be described how the prior art copying machine 51 often produces copies of incorrect density and/or gray backgrounds. A section "A" of an electrostatic image 63 formed on the drum 52 is assumed to be solid black as indicated by hatching. Conversely, a section "B" of the image 63 is assumed to be solid white, constituting a background area. Where the drum 52 is rotated such that the image 63 moves in the direction of an arrow 64 and the section "A" is sensed by the electrode 61, the control unit 62 assumes that the potential of the section "A" is that of the background area and sets the exposure and bias voltage excessively high. The result is an almost completely blank copy.

The general configuration of the copying machine 51 can be improved by moving the developing unit 57 away from the electrode 61 by a distance equal to or greater than the length of the electrostatic image. The control unit 62 may then be adapted to set the exposure and bias voltage in accordance with the lowest value of sensed potential over the entire electrostatic image. In the case of the image 63, the lowest sensed potential would be that of the white area 63 and the copy would be produced with correct density. However, such an expedient is not practical in an actual electrostatic copying machine due to the rather rapid attenuation of the electrostatic image as a function of time. This primary design consideration makes it necessary to position the developing unit 57 as close as possible to the optical system 58 in the direction of movement of the drum 52 and precludes sensing all but a very small leading edge portion of the electrostatic image.

Figure 4:
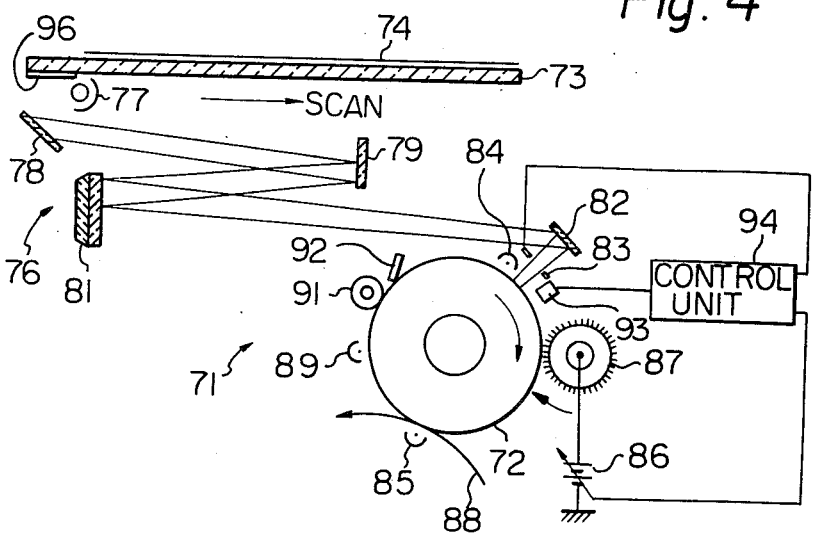
FIG. 4 is similar to FIG. 3 but shows another electrostatic copying machine of the invention.

These problems are overcome in an electrostatic copying machine 71 embodying the present invention which is illustrated in FIG. 4. A photoconductive drum 72 is rotated clockwise at constant speed below a transparent glass platen 73 which supports an original document 74 thereon facing downwardly. An exposure optical system 76 is shown as comprising a light source 77 which illuminates the document 74 from below through the platen 73. A light image of a linear portion of the document 74 is reflected from a plane mirror 78 to a plane mirror 79 from which it is reflected to a converging lens 81 provided with a plane rear reflecting surface. The lens 81 converges the light image and reflects the same from a plane mirror 82 through a slit diaphragm 83 onto the drum 72. The focal length of the lens 81 and proportions of the optical system 76 are selected so that the light image is focussed on the drum 72. The lamp 77 and mirror 78 are moved integrally in the rightward direction at the same surface speed as the drum 72 (for unity magnification) for scanning the document 74. The mirror 79 is also moved rightwardly but at one-half the surface speed of the drum 72. After the electrostatic image is formed, the lamp 77 and mirrors 78 and 79 are returned to their original leftward positions in preparation for another copying operation.

A corona charging unit 84 is illustrated which uniformly charges the drum 72 prior to exposure. A variable bias voltage source 86 provides a bias voltage for a magnetic brush developing unit 87. A transfer charger 85 applies an electrostatic charge through the back of a copy sheet 88 to transfer the toner image thereto. Further illustrated are discharging unit 89 to discharge the drum 72, a cleaning roller 91 to remove residual toner substance from the drum 72 and a scraper blade 92 to assist the cleaning roller 91.

The developing unit 87 is provided as close as possible to the exposure optical system 76 in the direction of movement of the drum 72 and an electrode 93 is disposed closely adjacent to the drum 72 between the optical system 76 and the developing unit 87. The electrode 93 functions in the same general manner as the electrode 61 illustrated in FIG. 5 and is connected to a control unit 94 which controls the diaphragm 83 and bias voltage source 86 in accordance with the sensed electrostatic potential.

The present copying machine 71 differs radically from the prior art machine 51 in that the machine 71 comprises a reference surface 96 near the left edge of the platen 73. The reference surface 96 may be in the form of a coating of paint on the lower surface of the platen 73 or may be a piece of plastic, cardboard or the like. The reference surface 96 has a predetermined optical density and is preferably white, corresponding to the optical density of a piece of white paper. Thus, the reference surface 96 corresponds to the background density of a printed white page which is the most common form of original document 74.

In operation, a reference light image of the reference surface 96 is radiated onto the drum 72 during the first portion of the rightward scan operation prior to radiation of the light image of the original document 74. The reference light image produces a reference electrostatic image on the drum 72 having a potential corresponding exactly to that of the background areas of the actual original document 74. This reference electrostatic potential is sensed by the electrode 93 and the exposure and bias voltage are set in accordance therewith under control of the control unit 94. The light image of the original document 74 is subsequently radiated onto the drum 72 at the exposure and bias voltage settings determined from sensing the reference electrostatic image. The settings are not changed during the course of scanning the original document 74.

To summarize the above, an electrostatic potential corresponding to the density of the reference surface 96 and thereby the background areas of the original document 74 is sensed and the exposure and bias voltage are set in accordance therewith. Subsequently, the light image of the original document 74 is radiated onto the drum 72 at these settings. This arrangement compensates for deterioration of the optical system 76, drum 72 and other components of the copying machine 71 and produces copies of proper density regardless of the type of original document. A true copy will be produced even of an original document corresponding to the image 63. In other words, excellent copies will be produced of all original documents regardless of the type of matter printed on the original document. Even photographs having dark backgrounds will be copied perfectly.

Figure 7:
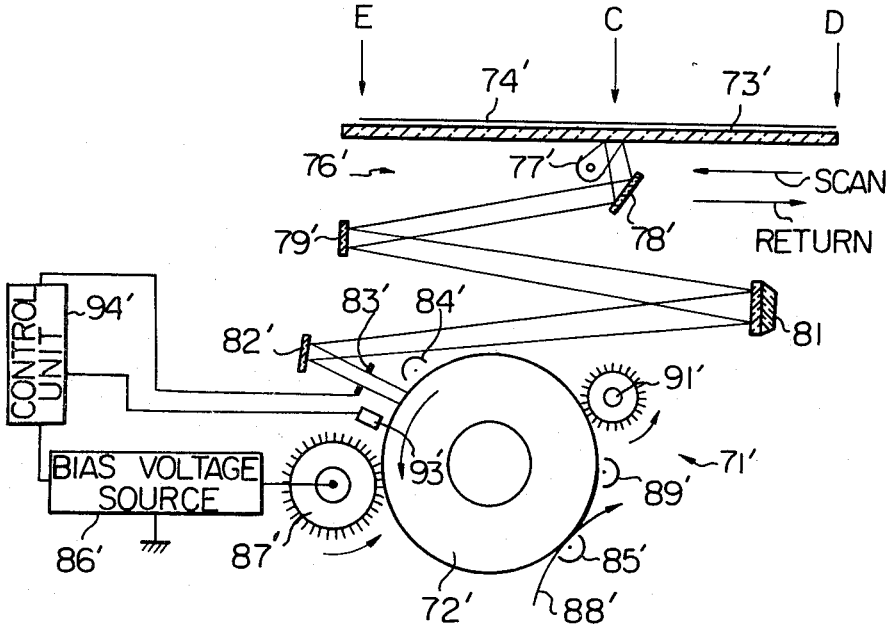
FIG. 7 is a schematic view of another electrostatic copying machine of the invention.

FIG. 7 illustrates another embodiment of the present invention in which like or corresponding elements are designated by the same reference numerals primed. A copying machine 71' differs from the copying machine 71 in that the reference surface 96 is omitted and the scan operation is modified in a novel and unique manner. In the copying machine 71' the scan direction is leftward and the return direction is rightward. Rather than starting the scan operation at a leftward edge of an original document 74', designated as "D", the scan is initiated at a position "C" which is between the position "D" and a leftmost edge of the document 74' which is designated as "E". At the end of each copying operation a light source 77' and mirror 78' are not returned to the position "D" but to the position "C", and a mirror 79' is moved to a corresponding position.

In operation, the light source 77' is energized and the document 74' is scanned in the rightward or return direction from the position "C" to the position "D". A reference electrostatic image formed by this reverse scanning operation is formed on a drum 72' and sensed by an electrode 93'. A control unit 94' sets the exposure and bias voltage in accordance with the sensed electrostatic potential, preferably in accordance with the lowest sensed value thereof.

The scan is then reversed and the original document 74' is scanned in the normal manner from the position "D" to the position "E", thereby forming an electrostatic image of the document 74' on the drum 72'. This electrostatic image is developed and transferred to a copy sheet 88' in the same manner described hereinabove. When the scan reaches the position "E" at termination of the actual scanning operation of the document 74', the scan is again reversed and the light source 77' and mirror 78' returned to the position "C". To conserve electrical power and maximize the life of the light source 77', the light source 77' is preferably de-energized during the return scan from the position "E" to the position "C".

The scan starting position "C" may be anywhere between the positions "D" and "E". Maximum reliability is provided where the positions "C" and "E" coincide, in which case the entire return scan is used for sensing the potential of the reference electrostatic image. However, in consideration of maximizing the life of the light source and conserving electrical power, the position "C" is generally selected far enough from the position "D" to ensure reliable sensing but as close to the position "D" as possible to minimize the length of time per copying cycle that the light source 77' is energized. It will be understood that there is no increase in copying time per cycle since only one scan reciprocation is required, the same as in prior art copying machines.

In order to increase copying speed, it is desirable to make the return speed faster than the scan speed. In other words, rightward movement of the light source 77', mirror 78' and mirror 79' is faster than the leftward movement thereof. The operations of sensing the electrostatic potential and adjusting the exposure and bias voltage in accordance therewith are not effected by such a speed increase, as the control unit 94' may be adapted to process the reference electrostatic image in compressed form.

In summary, it will be seen that the present invention overcomes the problems of deterioration of developing substance and various components of an electrostatic copying machine in a novel and unique manner and produces perfect copies of any original document. Various modifications will become possible for those skilled in the art after receiving the teachings of the present disclosure without departing from the scope thereof. For example, the invention may easily be adapted to a copying machine in which the platen is moved for scanning and the optical system is maintained stationary. The photoconductive member may be in the form of an endless belt or sheet rather than a drum. In FIG. 4, means may be provided to clean the reference surface 96 at periodic intervals, although not illustrated.

What is claimed is:

1. In an electrostatic copying machine including a photoconductive member, a charging unit for applying a uniform electrostatic charge to the photoconductive member and an exposure means for radiating a light image of an original document onto the photoconductive member to form an electrostatic image thereon through localized photoconduction, the improvement comprising:

first control means for controlling the exposure unit to radiate a reference light image onto the photoconductive member to form a reference electrostatic image thereon;

sensor means for sensing an electrostatic potential of the reference electrostatic image; and second control means for controlling the exposure unit in such a manner as to regulate an intensity of the light image of the original document in accordance with the sensed electro-potential of the reference electrostatic image;

said exposure means comprising a scan member movable in a scan and a return direction for radiating the light image of the original document onto the photoconductive member, the first control means controlling said exposure means to move the scan member by a predetermined distance in the return direction for radiating the reference light image onto the photoconductive member, the reference light image being constituted by a light image of a portion of the original document corresponding to the predetermined distance the scan member is moved in the return direction.

2. A copying machine as in claim 1, further comprising developing means and bias source means for applying a bias voltage to the developing means, the second control means further controlling the bias source means in such a manner as to regulate the bias voltage in accordance with the sensed electrostatic potential of the reference electrostatic image.

3. A copying machine as in claim 1, in which said exposure means moves the scan member faster in the return direction than in the scan direction.

4. A copying machine as in claim 1, in which said exposure means comprises a diaphragm means controlled by said second control means to regulate the intensity of the light image of the original document.

* * * * *